United States Patent [19]

Kuhn

[11] 3,973,094

[45] Aug. 3, 1976

[54] TWO-STAGE SNAP-ACTION SWITCH

[75] Inventor: Edward H. Kuhn, Milwaukee, Wis.

[73] Assignee: Allen-Bradley Company, Milwaukee, Wis.

[22] Filed: Apr. 28, 1975

[21] Appl. No.: 572,539

[52] U.S. Cl. ..... 200/67 PK; 200/76

[51] Int. Cl.[2] ..... H01H 13/28

[58] Field of Search ..... 200/76, 67 PK, 67 E, 200/67 D, 153 T, 67 R, 67 B, 67 A

[56] References Cited

UNITED STATES PATENTS 1,799,099 3/1931 Johnson ..... 200/67 PK

FOREIGN PATENTS OR APPLICATIONS 21,214 5/1965 Japan ..... 200/76

*Primary Examiner*—David Smith, Jr.
*Attorney, Agent, or Firm*—Arnold J. Ericsen

[57] ABSTRACT

A snap-action mechanism for an electrical switch, such as a pushbutton, which has an operator for reciprocally moving an overcenter operated contact by means of a drive toggle actuated mechanism to provide positive actuation of the contact through lost motion connection between the various operating members. The mechanism combines the antitease action of a snap switch with the opening ability of a directly operated slow action switch. The application of the direct opening force is not dependent on any springs and occurs in both directions of travel of the switch actuator.

8 Claims, 6 Drawing Figures

TWO-STAGE SNAP-ACTION SWITCH

BACKGROUND OF THE INVENTION

This invention relates to toggle actuated, snap-action switches having two-stage operating characteristics suitable for opening and closing electrical contacts. Over-toggle drive spring members are provided to initiate the force required for operating the contacts by means of an operating member. The operating member serves to actuate additional over-toggle contact operating mechanisms and thereby provide increased contact pressure.

Heretofore, many snap-action toggle operated switches were of a construction that permitted "teasing" of the contacts, especially when the switch mechanism was manually operated. In addition, although previous constructions were suitable for use in both manual and mechanical applications, they were principally designed for mechanical or cam operated applications, such as those used in limit switches having specially designed levers with cam followers rotatably attached to the outer ends of the levers.

The present switch module takes the general form of the module illustrated and claimed in U.S. Pat. No. 3,769,474 granted to Deubel et al, and assigned to the assignee of the present invention. The Deubel et al patent disclosed a switch module which provided an advancement in the art which served a needed purpose of closing and opening electrical contacts in response to slowly advancing actuation, as in thermostatic controls or the like. The main objective of the invention, as set forth in the patent, was to minimize the problems of prior switches which tended to hover for considerable periods in close vicinity of the snap-over point without positively forcing the contacts into engagement or disengagement. Such hovering conditions often led to detrimental heating and welding of contact. The construction of U.S. Pat. No. 3,769,474 provided a relatively short stroke of operation and tripped within close limits, requiring additional precision in calculating the trip points.

In the present switch construction, the mechanism is designed for both mechanical and manual application, and provides contact spinners which are both electrically and mechanically isolated from one another. The switch mechanism is rugged and has a relatively long operating stroke. In addition, there is a positive contact break feature which enhances the ability to disengage the contacts should an external circuit condition tend to cause them to overheat or weld. The construction further permits actuation of the contacts under positive force by the operator in either direction, even in a remote case where the drive springs do not provide sufficient force because of breakage, accidental removal, etc. Thus, in the case of a pushbutton, the operator may either be manually actuated to directly open the contacts or disengage the contacts, and thereby override the toggle action. In other words, a relatively large force exerted against the operator may be transmitted directly to the contacts, as in the case of pushbuttons, foot switches or limit switches placed in relatively rugged operating environments.

SUMMARY OF THE INVENTION

The present invention resides in a snap-action switch having a reciprocally movable actuator that receives an operating force, which force is transmitted to an operator controlled by an overcenter drive mechanism coacting with lost motion means to provide a snap-acting force directly to the operator, and independently of the initiating force once the drive mechanism has reached an overcenter position. The overcenter driving force moves the operator to actuate a toggle mechanism associated with a movable electrical contact and which provides snap-acting forces through its mechanism to the movable contact with respect to its position relative to a stationary contact. The operator is further constructed to provide positive actuation in either of its reciprocal operating directions to a movable contact in the event of failure of the movable contact to operate under normal toggle action.

In its preferred form, the operator is disposed in an enclosed housing of insulating material, and is of a cage-like construction, also of insulating material, including a top portion having an aperture for receiving a tongue-like portion depending from a spring biased actuator. The aperture has spaced upper and lower wall surfaces of sufficient spacial dimension to provide a "lost motion" means for actuating the operator. Driving toggle springs are disposed between the operator and the housing. The opposite ends of the driving toggle springs are each seated in opposed, supporting grooves respectively located in the operator and in the housing. The cage-like operator has parallel sidewalls integral with and depending from the top portion. Each of the opposed sidewalls are also apertured to freely receive laterally extending portions of a movable, conducting spanner. Contact members are secured to the laterally extending portions of the spanner for engagement with stationary contact members supported by the housing. The contact arrangement may be either normally open or normally closed as will hereinafter be described. The apertured sidewalls also include spaced apart, inwardly extending, shoulder portions for reciprocally operating the spanner and its contacts. The spanner is also apertured to freely receive a stationary toggle support. The toggle support is grooved at either side thereof and arranged to receive generally U-shaped contact toggle springs seated at opposite sides and in the grooves of the support at one end thereof, and with the other end being engaged with opposite sides of the aperture of the spanner.

Thus, an initiating force supplied to the actuator is directly transmitted to the operator until the driving toggle springs are forced to overcenter position. Because of the provision of the lost motion means, the snap-action force of the driving toggle springs will then follow through to move the operator. The force of the driving toggle springs causes the operator to move the contact spanner upon contact of the inwardly extending shoulder portions of the sidewalls against the spanner. This motion causes the spanner toggle springs, which are weaker than the driving toggle springs, to be moved past their respective overcenter positions to provide snapaction operation of the movable contacts for movement relative to the respective stationary contacts. The double toggle action virtually eliminates possibility of "teasing" the movable contacts which has been a problem with prior art devices, particularly when such devices are manually operated. Also, contact pressure will remain virtually constant until the moment of contact separation, because of the high speed, snap-action of the relatively strong driving toggle springs.

It is, therefore, an object of the present invention to provide a snap-action switch including overcenter toggle means for providing snap-action to a movable contact, and which toggle means is further controlled by additional driving toggle means to provide independent and rapid snap-action, once sufficient initiating force has been applied to operate the driving toggle means past overcenter position and, thereby, virtually eliminating the possibility of manually "teasing" the operation of the movable contact.

Another object of the invention is to provide a snapaction switch with direct linkage from an actuator, through an operator directly contacting a movable contact spanner member, such that if the movable contact should fail to snap over for any reason, shoulder portions of an apertured sidewall of the operator will physically force the contact towards open position. This action will occur in reciprocal directions in the case of two circuit, double spanner, two-state operation of the switch.

A further object of this invention is to provide a switch mechanism which includes all of the features of a snap-action contact construction, such as antitease and quick opening, for normal operation, along with the direct opening ability of slow make-break contacts for couteracting abnormal operating conditions.

DESCRIPTION OF THE PREFERRED EMBODIMENT

Figure 1:
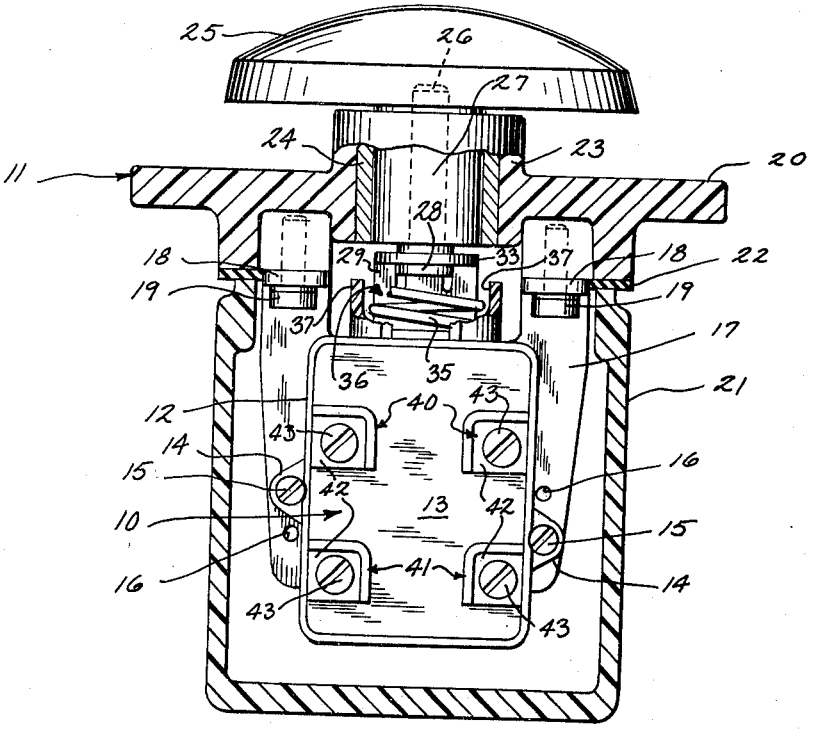
FIG. 1 is an elevational view, partly in section, of a pushbutton device embodying the present invention.

Referring first to FIG. 1 of the drawings, it will be observed that the switch module, indicated generally by the reference numeral 10, may be used in conjunction with a manually operated pushbutton, indicated generally by the reference numeral 11. The switch module 10 includes a suitable housing of molded material 12 enclosed by means of a molded cover plate 13. The housing 12 is provided with eccentrically located apertured mounting ears 14 at either side thereof. The mounting ears 14 are arranged to receive mounting screws 15 which threadingly engage one pair of two sets of tapped mounting holes 16 tapped into a mounting plate 17 from opposite sides thereof to receive two switch modules when so desired. Only one module is shown for purposes of illustration. The eccentric mounting hole and mounting ear arrangement permits addition and removal of respective modules without disturbing the opposite module as in the case of a single nut and bolt arrangement engaging registering apertures (not shown).

The mounting plate 17 includes forwardly bent, apertured mounting ears 18 for receiving mounting screws 19, which in turn, are received by tapped holes in the cover plate 20 of the pushbutton 11. The pushbutton cover plate 20 is attached to an enclosure 21 by means of screws (not shown) and the enclosure 21 and plate 20 are sealed by means of a flexible gasket 22.

Figure 3:
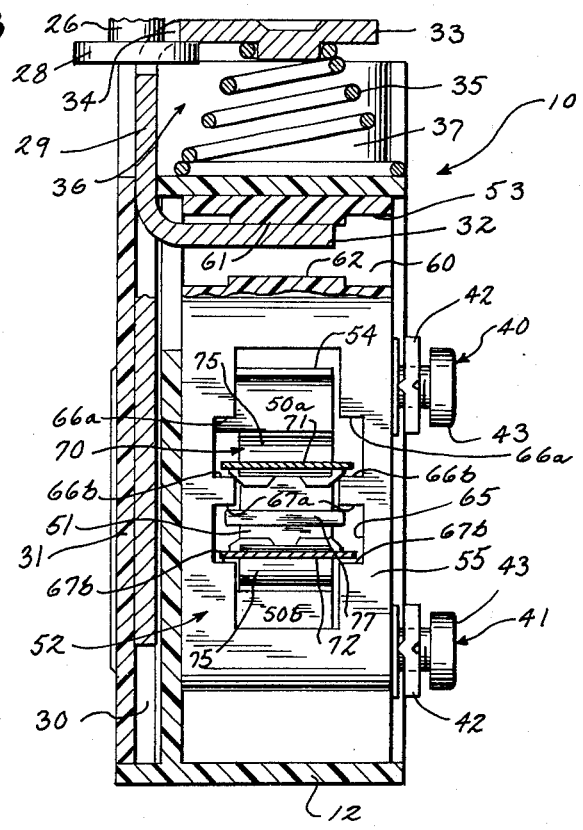
FIG. 3 is a sectional view of the switch module taken along lines 3—3 of FIG. 2.
Figure 6:
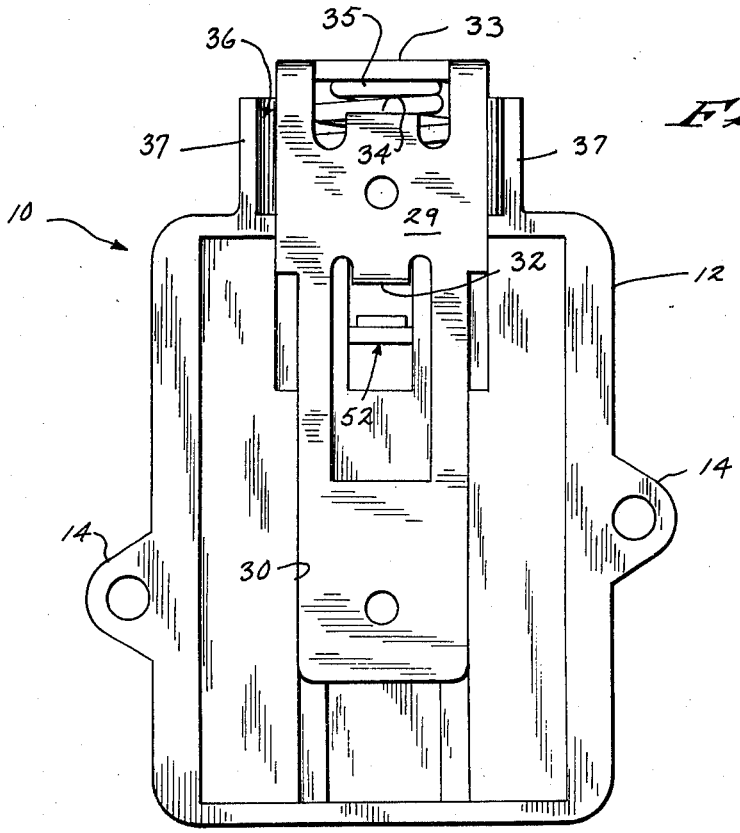
FIG. 6 is a rear view of the switch module of FIG. 3–5, inclusive, with the rear cover plate removed for clarity of illustration.

The cover plate 20 is further formed to provide an integral, apertured bearing portion 23 for receiving a bushing 24. As shown in FIG. 1, a palm operated button 25 is threaded to a stud 26 extending through a mandrel 27 slidably received in the bore of the bushing 24. Stud 26 is headed, at the lower end thereof, to provide a radially extending, annular flange 28. The flange 28 of the stud 26, in combination with the mandrel 27, provides an annular groove which accepts the actuator 29 to permit the actuator 29 to be downwardly or upwardly with respect to FIG. 3. The slide member, or actuator, 29 is stamped and formed from sheet metal and extends, as shown in FIGS. 3 and 6, along the rear wall of the housing 12 and is guided in its reciprocal movement by a longitudinal groove 30 formed in the rear wall of the housing 12. The slide member 29 is further held in place by a rear cover plate 31 cemented or otherwise fastened to the housing 12.

The actuator, or slide member, 29 is pierced and lanced to provide a laterally extending, integral tongue portion 32, and is further formed at its uppermost end with an overhanging leg portion 33. A notched portion 34 is provided to receive the flange 28 of the stud 26. As will be apparent, the head or flange 28 of the stud 26 is of such diameter or dimension as to extend laterally towards the left of FIG. 3 to simultaneously engage another switch assembly (not shown) when so desired. The slide 29 is biased upwardly with reference to FIGS. 3 and 6 by means of a compression spring 35. The spring 35 is disposed within the confines of an open-ended chamber 36 formed by opposed wall surfaces 37 extending from and formed integrally with the insulating housing 12. The spring 35 has one end resting on the floor of the chamber 36 and the other end presses against the underside of the overhanging leg portion 33 of the slide member 29. It will be apparent that the bias of the spring 35 is of sufficient strength to maintain the various components of the switch module 10 in the normal operating position shown in FIG. 2. Manual pressure upon the button 25 will act against this bias to operate the device, as will be later described.

The switch module 10 is provided with terminal assemblies indicated generally by the reference numerals 40 and 41. Each of the assembies 40 and 41 comprise conventional wire clamps 42 and threaded screws 43. The screws 43 are arranged to engage threaded apertures in the respective terminals 44, the details of which are not specifically shown and which are not a part of the present invention. For general information purposes, the terminals comprise a metal stamping formed in a general U-shape with a relatively elongated arm supporting a respective stationary contact 45. The contacts 45 are welded or otherwise conventionally fastened to the arm of each terminal 44. The legs of the terminals 44 are each inserted into spaced, reentrant holes in the housing 12 and are retained by force fit and/or cement.

Figure 2:
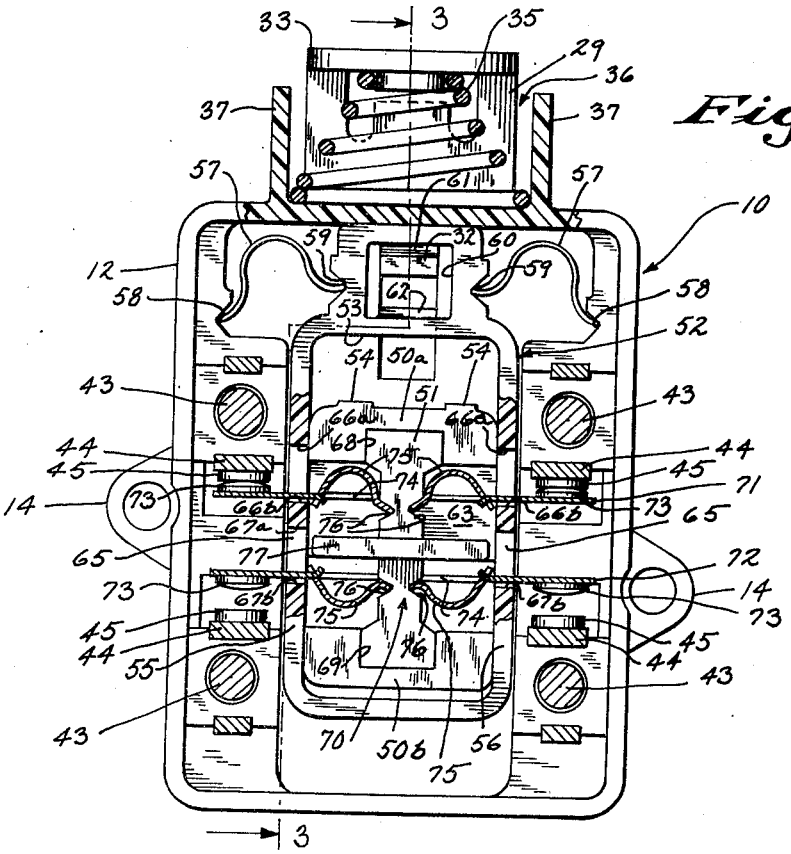
FIG. 2 is a view in elevation, partly in section, of the switch module illustrated in the device of FIG. 1, with the cover removed and illustrating a double spanner, two circuit version of the pushbutton device.

With particular reference to FIG. 2, it will be observed that the switch module or assembly 10 is box-like in construction, molded of insulating material, and includes a removable insulating cover plate 13 (see FIG. 1). Integrally molded, upstanding, stationary guide members 50a and 50b are provided in spaced relationship with one another. The guide members 50a and 50b are arranged to receive a stationary toggle support 51 positioned therebetween. The toggle support 51 is assembled to contact spanners, as will hereinafter be described.

The stationary, spaced apart guide members 50a and 50b are arranged for slidably receiving the window of a reciprocally movable, cage-like operator 52. The window is of general rectangular configuration defined by an upper wall surface 53 and parallel sidewalls 55 and 56, and back brace 63. Downward movement of the operator 52, with respect to FIG. 2, is stopped upon contact of its upper wall surface 53 and the relatively flat stop surfaces 54 of the upper guide member 50a (see FIG. 5). As shown in FIG. 2, the operator 50 is positioned in its normal operating position with its very uppermost surface resting against the inner surface of the upper wall of the housing 12.

Generally, U-shaped driving toggle springs 57 are provided, and are positioned with their outwardly flared extremities being retained in V-shaped notches 58 formed in the housing 12 and V-shaped notches 59 formed in the operator 52. The driving toggle springs, although preferred as illustrated for reasons of simplicity of design may also take other forms, such as compression springs (not shown).

It will be apparent that the operator 52 is also provided with an aperture 60 defining spaced apart pads 61 and 62 arranged to contact the upper and lower surfaces, respectively, of the tongue portion 32 extending from the slide member, or actuator, 29. The spaced apart relationship of the pads 61 and 62 provide for "lost motion" operation of the operator 52 with respect to the actuator 29 for purposes hereinafter described. The sidewalls 55 and 56 of the operator 52 are each further provided with an aperture or window 65 having a general configuration resembling a double-barred cross (see FIG. 3) each of the "bar" portions of the window 65 are provided with oppositely disposed shoulder portions 66*a*, 66*b*, 67*a* and 67*b*, respectively.

The movable contact assembly, designated generally by the reference numeral 70, is preferably preassembled, and includes the molded, stationary toggle support 51, which support is configured to provide opposite end portions arranged to be seated in notches 68 and 69 of the guide members 50a and 50b. The toggle support 51 is held in place by means of protuberances (not shown) integral with and extending inwardly from the cover plate 13 and pressing against the support 51. The assembly 70 also comprises conducting spanners, or blades 71 and 72, stamped from conducting material. The spanners 71 and 72 each carry movable contacts 73 at the respective extremities thereof. Each of the spanners 71 and 72 include a central rectangular opening 74 of sufficient dimension to freely receive the insulating toggle support member 51. The construction is similar to the construction of the contact toggle assembly illustrated in FIG. 3 of U.S. Pat. No. 3,769,474 assigned to the assignee of the present invention. However, the device of that invention, in contrast, utilizes a movable, rather than stationary, toggle member. Two U-shaped toggle springs 75 are provided for each of the spanners 71 and 72 and are each inserted in the respective central openings 74 of the spanners 71, 72 and are held under compression between the ends of the openings 74 and the V-shaped notches 76 of the toggle support 51. In this fashion, the toggle springs 75 are held captive and exert forces upon the movable contact spanners 71 and 72 to urge the respective spanners 71, 72 either upwardly or downwardly, depending upon whether the inner ends of the toggle springs 75 act upon the toggle support 51 above or below the respective spanner 71 or 72.

The stationary toggle support 51 is further provided with an intermediate laterally extending flange 77 which substantially fills the cavity between the sidewalls 55 and 56 and the front and back of the cage-like operator 52. This flange acts as a deterrent for any parts of the upper contact spanner 71 and its various operating components from falling through and making electrical contact with the lower spanner 72, in case of accidental breakage or slippage of the parts from their desired position. It will be apparent that the windows 65 of the sidewalls of the operator 52 is of sufficient dimension to receive the preassembled assembly 70 therethrough prior to seating of the stationary toggle support in the respective notches 68, 69 of guide members 50*a*, 50*b*, respectively.

DESCRIPTION OF OPERATION

It will be apparent from the foregoing description and drawings figures that the pushbutton embodiment of the present invention provides a two circuit, double spanner, two stage operation. The pushbutton 11 has particular application as a palm operated, snap-action switch, with direct mechanical linkage between the operating button 25 and the sets of contacts 45 and 73. The pushbutton 11 features all the benefits of snapaction contacts (antitease, quick opening, etc.) for normal operation. It also has the direct opening benefits, under abnormal conditions, of slow break/make contact. Thus, manual pressure in either direction exerted upon the palm type button 25 is transmitted directly to the slide member 29 through the stud 26 and its flange 28 inserted in the notch 34 (see FIG. 3). FIGS. 2 and 3 illustrate the various components of the switch module 10 and the slide 29 and their normal operating position. Spring 35 biases the slide 29 and the button 25 upwardly with respect to FIGS. 1–3, inclusive.

It will be observed that manual force exerted downwardly upon the button 25 with respect to FIG. 2 will force the tongue 32 of the slide 29 to travel downwardly in the aperture 60 of the operator 52 and bottom against the pad 62. Continued pressure exerted on the button 25 will then force the operator 52 downwardly against the bias of the driving toggle springs 57. The view of FIG. 4 serves two purposes; first it illustrates the operating components just after the toggle springs 57 have been moved past center position, but just prior to movement of the normally closed, movable contacts 73 of the spanner 71 and the normally open, movable contacts 73 of the spanner 72 towards their alternate operating position. Although not specifically illustrated, the gap between the shoulders 66*a* and 66*b* of the operator 52 and the spanners 71 and 72 will still be present until the toggle springs have moved past their unstable center position. It is essential that the operator be moving at speed at the time the shoulders 66*a* and 66*b* contact the spanners 71 and 72. This will provide desired snap-action and provide the force needed to operate the respective spanners 71 and 72. The gap between the top surface of tongue 32 and the pad 61 (see FIG. 4) permits the uninhibited travel of the operator 52 after the springs 57 move to overcenter position. This gap is equal to, or greater than, the travel distance of operator 52 after the springs 57 move past center.

The cage-like operator 52 ultimately bottoms on the upper surface of the upper stationary guide member 50a with the upper inner wall surface of the operator 52 abutting against the pads 54 on the guide member 50a. The spanner toggle springs 75 have not been shown in the illustrations of FIGS. 4 and 5 for sake of clarity in description, except for their plane of deviation shown in the dot-dash line. Suffice it to say that the springs 75 have a weaker spring force than that of the driving springs 57, and will accordingly be motivated by the spring force of the driving toggle springs 57.

Figure 5:
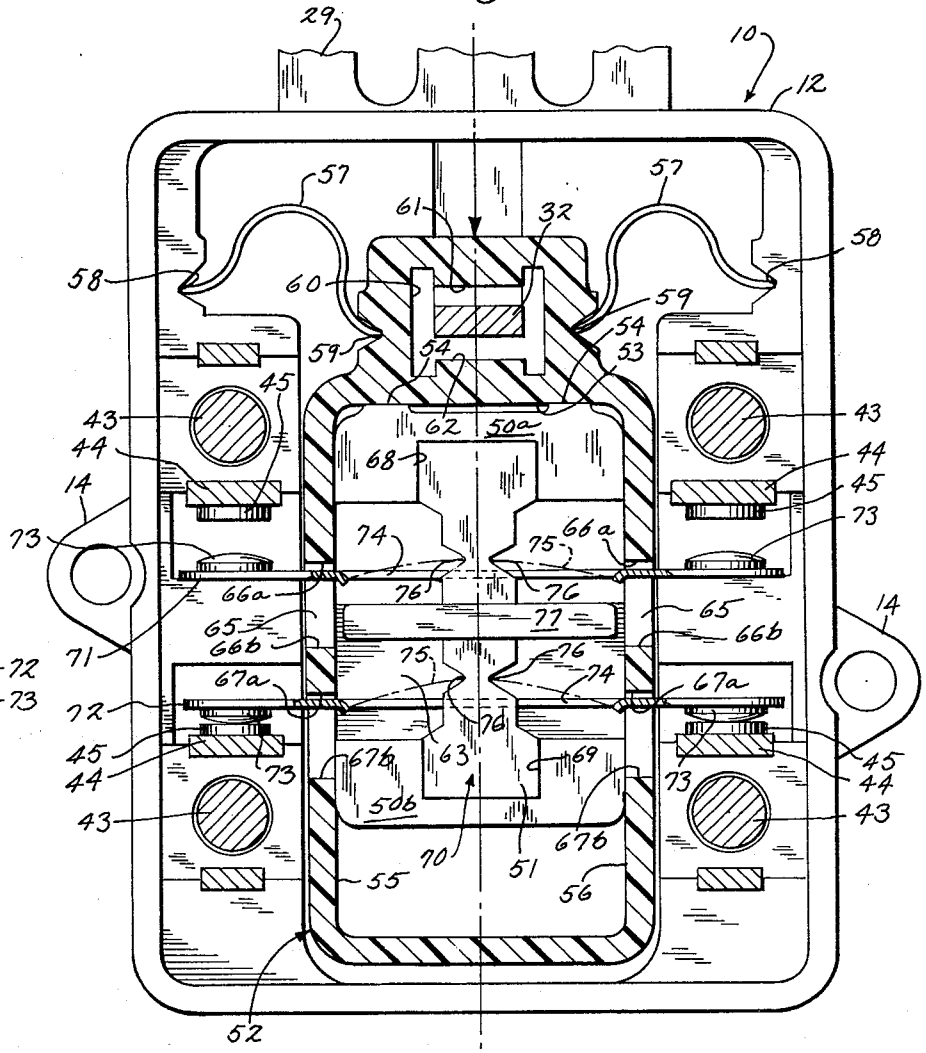
FIG. 5 is an elevational view partly in section and partly in fragment, similar to the view of FIG. 4, and illustrating the cage-like operator after it has been moved to the overcenter position of its driving toggle springs and with the contacts in their alternate operating position.

After the driving springs 57 have been moved to overcenter position, there will be an automatic follow-through action, independent of any manual force exerted upon the button 25. The shoulder 66*a* and 67*a*, during the travel of operator 52, will be pressed against the spanners 71 and 72, respectively, and cause their respective toggle springs 75 to operate to overcenter position and provide a snap-action motion to the spanners. Consequently, the movable contacts 73 will move to their respective alternate positions, as shown in FIG. 5. It will be observed from FIG. 5 that the tongue 32 of the slide 29 operates independently of the motion of the operator 52 because of the "lost motion" means provided by the spacial dimension between the pads 61 and 62.

Release of the button 25 will permit the spring 35 to exert its bias against the upper overhanging leg 33 of the slide 29 and cause the drive springs 57 to return overcenter to their rest position forcing the operator 52 to move upwardly to its rest position. The shoulders 66*b* and 67*b* of the window 65 will thereby force the respective spanners 71 and 72 upwardly with respect to the drawings and, thereby, cause their respective toggle springs 75 to return overcenter to rest position. The contacts 73 will then, accordingly, be returned to normal operating position as shown in FIGS. 1–3, inclusive.

Figure 4:
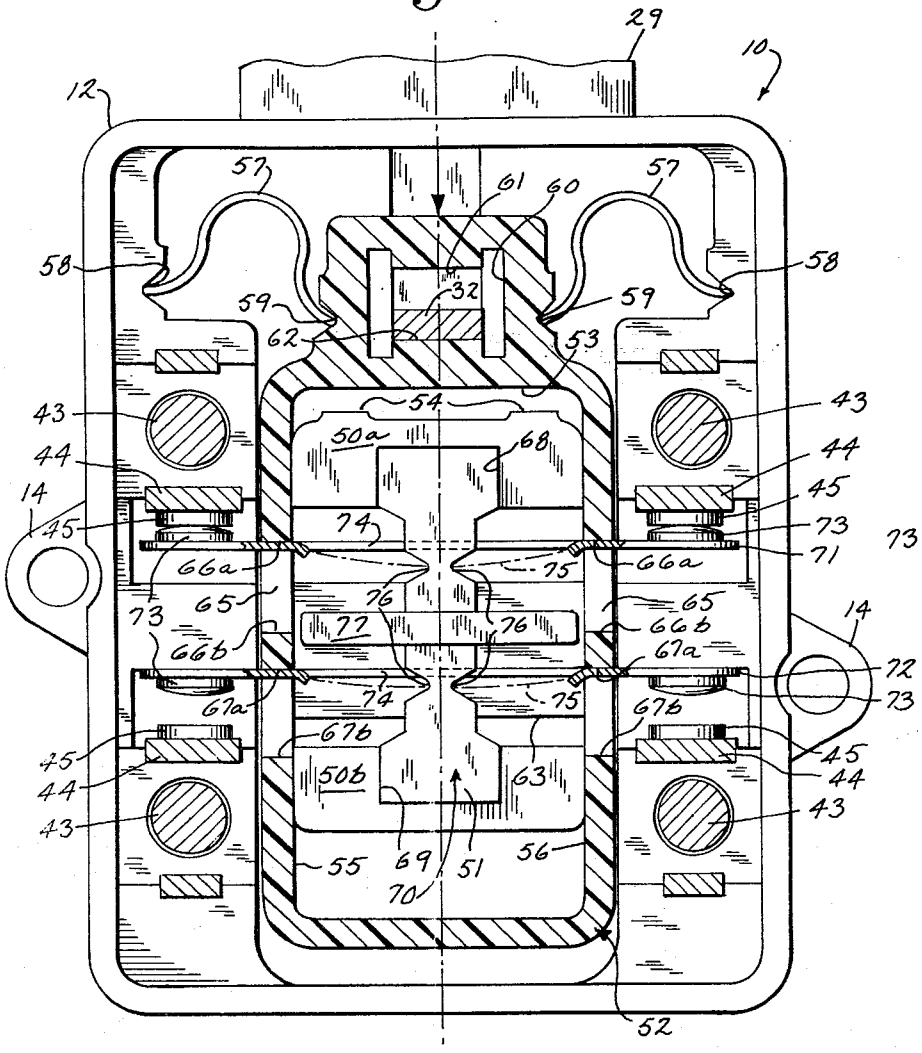
FIG. 4 is an enlarged view, partly in fragment and partly in section of the switch module of FIG. 2, with parts removed for purposes of clear illustration, and indicating an unstable position of the cage-like operator just prior to separation of the normally closed contact and engagement of the normally open contacts.

The second reason for presenting the view of FIG. 4 is to illustrate the capability of the operator 52 to actuate the spanners 72, even though the driving springs 57 might become inoperative, are missing or the contacts become welded. It will be further observed that abnormal functioning of the device which would in any way interfere with the normal operation of the movable contacts 73 in either of their respective alternative operating positions has been accounted for. The construction of the present device will permit reciprocal operation by either manual pressure or retraction of the button 25. That is, in the rare instance of any malfunctioning of either drive spring 57 or minor welding of contacts caused by abnormal line conditions, the operator 52 has been designed to permit its shoulders 66*a*, 66*b*, 67*a*, 67*b* to manually force the spanner 71 and 72 in either direction towards the desired position. In such case, the operator 52 may be actuated in either of the reciprocating directions, independently of the drive springs 57, to permit manual exertion in either direction upon the button 25 to physically force operation of the contacts independently of the snap-action provided by either set of toggle springs 57 and 75, and thereby allow a slow break/make operation of the contacts.

It will be apparent that the embodiment illustrated describes a two circuit pushbutton, but it is within the province of this invention to eliminate one or the other of spanners 71 or 72, or design a switch for single spanner operation, if so desired. Also, although the invention has been described with particular application to pushbutton switches, it will be apparent that the switch module 10 may be used with slight modification in other devices utilizing devices of this type.

I claim:

1. In a snap-action mechanism for an electrical switch including a reciprocally operated movable contact member operated by an overcenter spring means that has one end that acts upon the movable contact member and urges said contact member toward one of two positions depending upon which side of center said spring means resides, the combination therewith of:

a housing for said movable contact member and said overcenter spring means, and comprising stationary toggle mechanism support means and stationary operator guide means;

a movable actuator that reciprocates in a stroke between two positions;

means for biasing said actuator toward one of said positions;

a reciprocally movable operator in said housing guided by said operator guide means and having a lost motion connection with said actuator and with said overcenter spring means;

driving toggle spring mechanism for said operator interposed between said operator and said stationary toggle support means, the said driving toggle means having a relatively greater toggle spring force of said overcenter spring means for said movable contact member.

2. The combination of claim 1, wherein said reciprocally movable operator includes two parallel sides disposed at opposite sides of said operator guide means and apertured to receive and make positive contact with said overcenter spring means for providing said lost motion operation of said movable contact in either of the reciprocable positions thereof.

3. The combination of claim 2, wherein said overcenter spring means and movable contact means comprise a movable contact spanner, toggle springs interposed between said spanner and said operator guide means, which toggle springs are moved between opposite sides of an unstable central position by this motion of said operator, and apply snap-action forces upon said movable contact spanner in reverse directions responsive to reciprocable movement of said operator and said actuator.

4. The combination of claim 2, wherein said driving toggle spring mechanism comprises generally U-shaped toggle springs interposed between and at opposite sides of said movable operator and said stationary toggle support means.

5. The combination of claim 1, wherein said housing includes actuator guide means, and wherein said actuator comprises a relatively flat member slidably received for reciprocable movement by said actuator guide means and further comprising an end portion overhanging said housing, and wherein said actuator biasing means comprises a helical compression spring interposed between an exterior surface of said housing and said overhanging portion of said actuator.

6. The combination of claim 5, wherein the said actuator member includes a laterally projecting integral tongue portion, and said operator defines an aperture for receiving said tongue portion, said aperture being of sufficient dimension to provide lost motion between the tongue portion of said actuator and said operator, whereby said driving toggle spring mechanisms will actuate said movable contact overcenter spring means independently of said actuator after said drive mechanism has traveled passed an unstable toggle position.

7. In a snap-action mechanism for an electrical switch including a reciprocally operated movable contact member comprising a contact spanner support said movable contact member at a distal end thereof and operated by an overcenter spring means that has one end that acts upon the spanner movable contact member to urge said contact member toward one of two positions depending upon which side of center said spring means resides, the combination therewith of:

a housing for said movable contact member and said overcenter spring means, and comprising stationary support means for said overcenter spring means and stationary operator guide means;

a movable actuator that reciprocates in a stroke between two positions;

means for biasing said actuator toward one of said positions;

a reciprocally movable operator in said housing guided by said operator guide means and having a lost motion connection with said actuator and with said overcenter spring means, said operator having an apertured sidewall arranged to receive the contact spanner and to directly connect with the spanner for operation of the movable contact.

8. The combination of claim 7, wherein the spanner comprises a relatively flat leaf spring member apertured to receive said stationary support means and including overcenter spring means interposed between said support means and an edge defining the aperture.

* * * * *